United States Patent [19]

Chiang et al.

[11] Patent Number: 4,663,002

[45] Date of Patent: May 5, 1987

[54] ELECTROLYTIC PROCESS FOR MANUFACTURING POTASSIUM PEROXYDIPHOSPHATE

[75] Inventors: John S. C. Chiang, Mercerville; Michael J. McCarthy, Lawrenceville, both of N.J.

[73] Assignee: FMC Corporation, Philadelphia, Pa.

[21] Appl. No.: 759,715

[22] Filed: Jul. 29, 1985

[51] Int. Cl.[4] ..... C25B 1/28

[52] U.S. Cl. ..... 204/82; 204/182.4; 204/301

[58] Field of Search ..... 204/82, 182.4, 301

[56] References Cited

U.S. PATENT DOCUMENTS

| | | | |
|---|---|---|---|
| 2,593,915 | 4/1952 | Pavelka | 204/301 |
| 3,347,761 | 10/1967 | Bicek | 204/182.4 |
| 3,616,325 | 10/1971 | Mucenieks | 204/82 |
| 3,764,503 | 10/1973 | Lancey et al. | 204/182.4 |
| 3,909,382 | 9/1975 | Muller et al. | 204/182.4 |
| 4,134,805 | 1/1979 | Frohler et al. | 204/82 |
| 4,310,394 | 1/1982 | Malafosse et al. | 204/82 |
| 4,419,198 | 12/1983 | Breda et al. | 204/182.4 |

FOREIGN PATENT DOCUMENTS 2261225 12/1975 France .

*Primary Examiner*—T. Tung

*Attorney, Agent, or Firm*—R. E. Elden; R. L. Andersen; E. G. Seems

[57] ABSTRACT

The invention provides a process to maintain the anolyte pH within a range of 1 pH unit while manufacturing potassium peroxydiphosphate on a commercial scale. The process comprises electrolyzing an alkaline anolyte containing potassium, phosphate, and hydroxyl ions at a platinum or noble metal anode optionally in the presence of a reaction promoter. The catholyte, an alkali metal hydroxide, is separated from the anolyte by at least two separating means, one separating means permeable to either anions or cations, but not both, and the other separating means permeable to an ion excluded by the first separating means.

19 Claims, 2 Drawing Figures

ELECTROLYTIC PROCESS FOR MANUFACTURING POTASSIUM PEROXYDIPHOSPHATE

The present invention is a method for controlling the pH of an anolyte during the electrolytic manufacture of potassium peroxydiphosphate. More specifically, it relates to an electrolytic process for maintaining the anolyte within 1 pH unit of the optimum pH range, while manufacturing potassium peroxydiphosphate at a high degree of conversion.

Potassium peroxydiphosphate is known to be a useful peroxygen compound, but it is not yet an article of commerce because of the difficulty of maintaining the anolyte in the critical pH range of about 1 unit. The prior art teaches that control of the anolyte pH to about 1 pH unit is necessary for high efficiency, but the prior art processes are limited either to adding an acid or an alkali to the anolyte during electrolysis to achieve the needed pH control, or alternatively, to extend the operating pH range of the anolyte beyond the optimum to between pH 9.5 and 14.5 or more.

U.S. Pat. No. 3,616,325 to Mucenieks is incorporated herein by reference in its entirety. The patent teaches that potassium peroxydiphosphate can be produced at an anode on a commercial scale by oxidizing an alkaline anolyte containing 2 mols/liter potassium phosphate and 2.4 mols/liter potassium fluoride. The potassium phosphate catholyte is separated from the anolyte by a diaphragm. Hydrogen gas is formed at the stainless steel cathode by the reduction of hydrogen ions.

The process of U.S. Pat. No. 3,616,325 requires adding potassium hydroxide to the anolyte during operation to adjust its pH. U.S. Pat. No. 3,616,325 teaches the reason for this requirement is to obtain maximum conversion of phosphate ions to peroxydiphosphate ions at high current efficiencies. The current efficiency is determined by comparing the amount of peroxydiphosphate formed by a quantity of electricity with the theoretical amount of peroxydiphosphate which that quantity of electricity can produce. The current efficiency is a separate and distinct measurement from the degree of conversion or conversion efficiency in that the latter expresses only the percent of phosphate ions converted to peroxydiphosphate ions, regardless of the quantity of electricity used to effect the conversion.

U.S. Pat. No. 3,616,325 also teaches that as the degree of conversion increases the current efficiency decreases and the optimum pH range narrows to about 1 pH unit (pH 12–13). Consequently, optimum conditions for obtaining maximum degree of conversion can be obtained either by constantly adjusting the pH of the anolyte in the electrolytic cell by adding KOH or by commencing operation on the alkaline side of the preferred range and continuing electrolysis until the anolyte has reached the lowest pH at which operation is economical.

French Pat. No. 2,261,225 teaches a continuous process for producing potassium peroxydiphosphate electrolytically in an alkaline potassium phosphate electrolyte containing fluoride ions. The cell employs a cylindrical zirconium cathode, a platinum anode and does not contain a means to divide the cell into a separate anode and cathode compartment. Phosphoric acid is added during electrolysis for pH control. This is because without a separating means the cathode half-cell reaction increases the pH of the electrolyte above the optimum range. An additional disadvantage of the French process is that peroxydiphosphate ions can be reduced at the cathode. Thus, the prior art processes either employ separating means and require adding an alkali such as potassium hydroxide to control the anolyte pH or do not employ separating means and require adding phosphoric acid for pH control.

Copending U.S. patent application Ser. No. 741,785, filed June 6, 1985, teaches a process to produce potassium peroxydiphosphate without adding either potassium hydroxide or phosphoric acid to control the pH of the anolyte between 9.5 and 14.5. The process is carried out as a continuous or batch process in electrolytic cells separated into anode and cathode compartments by separating means preventing a substantial flow of an aqueous liquid between the anode and cathode compartments and substantially permeable to aqueous anions. The catholyte contains an aqueous alkali metal hydroxide, and optionally other anions such as phosphate. The anolyte contains potassium cations and 4 mols/liter phosphate ions and hydroxyl anions in sufficient quantity to maintain the anolyte between pH 9.5 and pH 14.5 with an optimum pH of about 13.5.

The present invention provides a process for producing potassium peroxydiphosphate in an anolyte by the electrolytic oxidation of an aqueous alkaline potassium phosphate solution. The process comprises introducing the anolyte into an anode compartment of an electrolytic cell or a plurality of cells, each cell consisting of at least one anode compartment with a noble metal anode and at least one cathode compartment containing a cathode and an aqueous solution of an alkali metal hydroxide as a catholyte. The anode and cathode compartments are separated by a first separating means and a second separating means, both of which prevent a substantial flow of aqueous solution between the adjacent anode and cathode compartments. The first separating means is permeable to either an anion or a cation but not both. The second separating means is permeable to the type of ion excluded by the first separating means and may be a porous diaphragm permeable to both anions and cations.

On applying an electrical potential between an anode and cathode, phosphate ions in the anolyte are oxidized to form peroxydiphosphate ions. Anions, primarily hydroxyl ions, are transferred from the catholyte through an anion permeable separating means such as a diaphragm or an anion membrane to conduct part of the electrical current and to neutralize hydrogen ions generated by an unwanted oxidation of water at the anode. Cations, such as potassium are transferred from the anolyte into the catholyte through either a diaphragm or cation membrane separating means.

It is critical for the present invention to use at least two different separating means, even if the process is carried out in a single cell with a single anode compartment and a single cathode compartment. For example, the cell could be divided into an anode compartment and a cathode compartment by a first separating means comprising an anion permeable membrane in one section of a cell and a second separating means in another section of the cell comprising a diaphragm permeable to both anions and cations.

In dividing the cell into an anode compartment and a cathode compartment it is contemplated that both the first and second separating means will each have one surface contacting anolyte and one surface contacting catholyte. It is further contemplated that a single physical structure such as a diaphragm permeable to both anions and cations could function as a first and second separating means, by coating one portion so that it is permeable to an anion or a cation but not both and leaving the remaining portion uncoated.

It is desirable to be able to control the quantity of hydroxyl anions transferred into the anolyte as the electrolysis proceeds. To accomplish this control one embodiment of the invention employs a cell or cells with first and second separating means forming either one anode compartment and two cathode compartments or two anode compartments and one cathode compartment and optionally provides means for adjusting the ratio of electric current conducted through the two separating means. The scope of the invention also comprises a plurality of cells of which at least one cell contains a first separating means and at least one cell contains a second separating means so that anolyte flowing through the plurality of cells is maintained within 1 pH unit of the optimum.

The anode can be fabricated from any electrically conductive material which does not react with the anolyte during electrolysis such as platinum, gold or any other noble metal.

Similarly, the cathode may be fabricated from any material which conducts an electric current and does not introduce unwanted ions into the catholyte. The cathode surface can be carbon, nickel, zirconium, hafnium, a noble metal or an alloy such as stainless steel or zircalloy. Desirably, the cathode surface will promote the desired cathode half-cell reaction, such as the reduction of water to form hydrogen gas or the reduction of oxygen gas to form hydrogen peroxide.

The cathode and anode can be fabricated in any configuration, such as plates, ribbons, wire screens, cylinders and the like. Either the cathode or the anode may be fabricated to permit coolant to flow therethrough or, alternatively, to conduct a fluid, including the anolyte or catholyte, into or out of the cell. For example, if the cathode reaction is the reduction of oxygen gas to form hydrogen peroxide, a gas containing oxygen can be introduced into the cell through a hollow cathode, or if agitation of the anolyte is desired, an inert gas can be introduced through a hollow anode.

A plurality of cells may be arranged so that the solution flows in parallel or in series (cascade) and may be operated continuously or batchwise.

An electric potential is applied between the anode and cathode, which potential must be sufficient not only to oxidize phosphate ions to peroxydiphosphate ions, but also to effect the half-cell reduction at the cathode and to cause a net flow of ions between the anode and the cathode, for example, a flow of anions, negative ions, from cathode to anode. Normally, an anode half-cell potential of at least about 2 volts has been found operable. When the cathode reaction is the reduction of water to form hydrogen gas, an overall cell voltage of about 3 to 8 volts is preferred.

The temperature of the anolyte and catholyte is not critical. Any temperature may be employed at which the aqueous electrolyte is liquid. A temperature of at least 10° C. is desirable to prevent crystallization in the anolyte and catholyte and a temperature of 90° C. or less is desirable to avoid excessive evaporation of water from the aqueous fluids. Temperatures of from 20° C. to 50° C. are preferred and more preferably from 30° C. to 40° C.

It is desirable for the anolyte to contain sufficient phosphorus atoms to be about equivalent to a 1 molar to 4 molar (1M to 4M) solution of phosphate ions, preferably 2 to 3.75 molar. The ratio of the potassium to phosphorus atoms, the K:P ratio, should range from 2:1 to 3.2:1; preferably, 2.5:1 to 3.0:1.

Optionally, the anolyte may also contain a reaction promoter, an additive which increases the current efficiency of the anode half-cell reaction. Suitable reaction promoters include thiourea and nitrate, fluoride, halide, sulfite and chromate anions. The reaction promoter may be incorporated into the anolyte in any convenient form such as an acid, as a salt, or any other form which does not introduce a persistent ionic species into the anolyte.

It is critical for the anolyte to be maintained within 1 pH unit (±0.5 pH unit of optimum) throughout the electrolysis. The optimum pH range for an anolyte feed 2 molar in phosphate is about pH 12.5±0.5; for anolyte feed 3.5 to 4 molar in phosphate the optimum is about pH 13.5±0.5.

Although the concentration of the alkali metal hydroxide in the catholyte is not critical, it is desirable for the catholyte to be at least one molar (1M) in hydroxyl ion concentration to minimize the voltage drop across the cell. Preferably, the catholyte should be at least 6 molar in hydroxyl ion concentration. The maximum concentration of the hydroxyl ion is limited only by the solubility of the alkali metal hydroxide selected for the catholyte. The concentration of the alkali metal hydroxide in the catholyte should be as high as feasible to minimize the power loss and also to minimize evaporation of water required when the potassium peroxydiphosphate is to be recovered from the anolyte.

If the electrolytic cell or plurality of cells is to be operated continuously, it is usually convenient to use potassium hydroxide as the alkali metal hydroxide in the catholyte. However, if the cathode half-cell reaction is the reduction of oxygen gas to form an alkaline hydrogen peroxide bleach solution, it is usually more economical for the alkali metal hydroxide to be sodium hydroxide. Optionally, the catholyte may contain other anions such as phosphate, thiocyanate, sulfite, nitrate or fluoride anions. When the catholyte is composed of both phosphate and hydroxyl anions, some of the phosphate anions will be transferred through the separating means into the anolyte, and there oxidized to peroxydiphosphate anions. On the other hand, if it is desirable to add reaction promoter anions to the anolyte during electrolysis, the catholyte can contain an alkali metal hydroxide and the reaction promoter compound so that both hydroxyl anions and reaction promoter anions are transferred through the separating means from the catholyte into the anolyte. This is a particularly effective means for maintaining an effective concentration of an easily oxidized reaction promoter compound in the anolyte, such as a thiocyanate.

The hydroxyl anions are known to have the greatest equivalent conductance of any ions species in either the anolyte or the catholyte. Even when only half of the anions in the catholyte are hydroxyl anions, sufficient hydroxyl anions are usually transferred from the catholyte to the anolyte to maintain the pH of the anolyte between 12 and 14 when the anolyte feed is 4 molar in phosphate. From the above, it will become clear to one skilled in the art that controlling the proportion of the hydroxyl anions to the total anions in the catholyte feed solution provides an additional means for controlling the pH of the anolyte during operation of the process.

The practice of the invention is not limited to any particular theory of operation. However, the following simplified discussion of the probable mechanisms involved is helpful to explain the best mode of operation to one skilled in the art.

Three competing anode reactions are:

$$2PO_4^{-3} \rightarrow P_2O_8^{-4} + 2e \quad E^\circ = 2.07v \tag{1}$$

$$H_2O \rightarrow \tfrac{1}{2}O_2 + 2H^+ + 2e \quad E^\circ = 1.23v \tag{2}$$

$$2OH^- \rightarrow \tfrac{1}{2}O_2 + H_2O + 2e \quad E^\circ = 0.40v \tag{3}$$

Reaction (1) oxidizes tribasic phosphate anions to the peroxydiphosphate anion at an anode. The standard electrode potential of this reaction is the greatest of the three reactions making it the least favored thermodynamically.

Reaction (2) oxidizes water to form oxygen and hydrogen ions and is a side reaction. The hydrogen ion produced has an undesirable effect of making the anolyte progressively less alkaline during electrolysis, thus converting tribasic phosphate needed by reaction (1) to dibasic phosphate, $HPO_4^{-2}$.

Reaction (3) is another unwanted side reaction. This reaction has the lowest anode potential and is the most favored thermodynamically. This reaction predominates when the concentration of $OH^-$ in the anolyte becomes appreciable.

The three reactions explain the relationship between current efficiency and pH disclosed in U.S. Pat. No. 3,616,325. Therefore, it is critical for hydrogen ions formed in the anolyte by reaction (2) to be neutralized by adding hydroxyl ions to the anolyte. It is also critical to avoid a sufficient excess of hydroxyl anions in the anolyte to permit reaction (3) to predominate, however, sufficient hydroxyl ions must be present in the electrolyte to maintain tribasic phosphate ions in the anolyte. These reactions also explain why the optimum pH varies with the composition of the anolyte.

Example 1 of U.S. Pat. No. 3,616,325 discloses that potassium hydroxide must be added to the anolyte during electrolysis at the rate of one quarter mol per mol of phosphate in the anolyte. Such dilution of the anolyte is undesirable as it reduces the concentration of the tribasic phosphate ion, and increases the amount of water to be removed during crystallization.

Copending application Ser. No. 741,943 filed June 6, 1985, teaches that a catholyte comprising an alkali metal hydroxide can supply hydroxyl ions during hydrolysis. However, the efficiency of reaction (1) initially is high and drops as the tribasic phosphate ion is converted to the peroxydiphosphate ion. Consequentially, the process tends to supply too much hydroxyl ion initially to favor reaction (3), and too little hydroxyl ion subsequently when the phosphate ion concentration drops in the anolyte to favor reaction (2).

The following figures illustrate two preferred embodiments of the present invention.

FIG. 1

Figure 1:
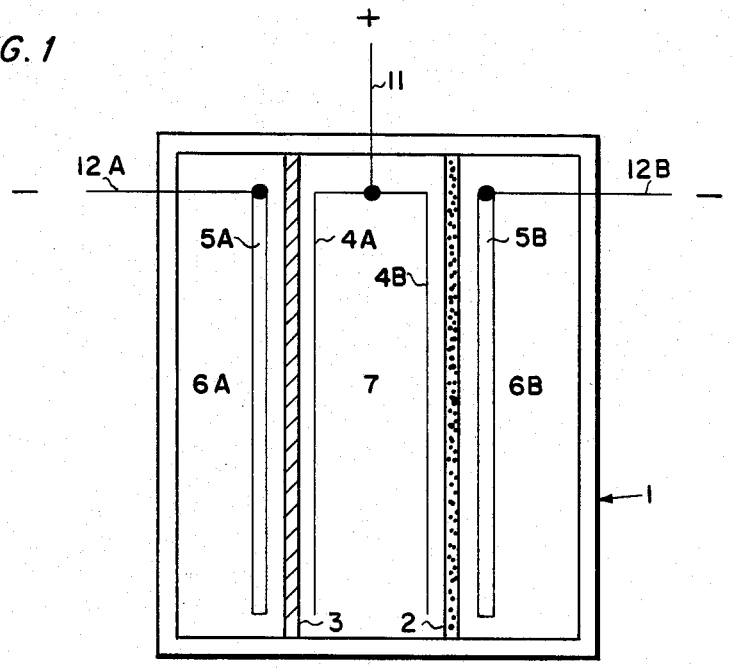
FIG. 1 is a plan view of an electrolytic cell useful for practicing the present invention particularly as a batch process.

Electrolytic cell 1 is divided by separating means 2 and 3 into anode compartment 7 and two cathode compartments 6A and 6B. Separating means 2 is either a porous diaphragm permeable to both cations and anions, or, optinally, a membrane permeable only to cations. Separating means 3 is a membrane permeable only to anions. Anodes 4A and 4B are located in anode compartment 7 and connected by electrical lead 11 to a positive direct current source (not shown). Cathodes 5A and 5B are located in cathode compartments 6A and 6B respectively and connected by electrical leads 12A and 12B to sources of negative electrical current, preferably separately controlled.

In operation anode compartment 7 is filled with an anolyte comprising an aqueous alkaline, potassium phosphate solution and cathode compartments 6A and 6B are each filled with an aqueous catholyte, comprising an alkali metal hydroxide. Either or both catholytes may also contain other anions such as phosphate. Initially the ratio of current flowing between cathode 5B and anode 4B is adjusted to transfer hydroxyl anions into anode compartment 7 from cathode compartments 6A and 6B in an amount sufficient to neutralize the hydrogen ions formed by reaction (2). As the electrolysis progresses the phosphate concentration of the anolyte drops, and the electrochemical efficiency also drops so that the rate of formation of hydrogen ions by reaction (2) increases. By increasing the relative electrical potential difference between cathode 5A and anode 4A compared with cathode 5B and anode 4B more hydroxyl anions will be transferred from cathode compartment 6A through separating means into anode compartment 7 thereby maintaining the pH of the anolyte within the desired range.

Figure 2:
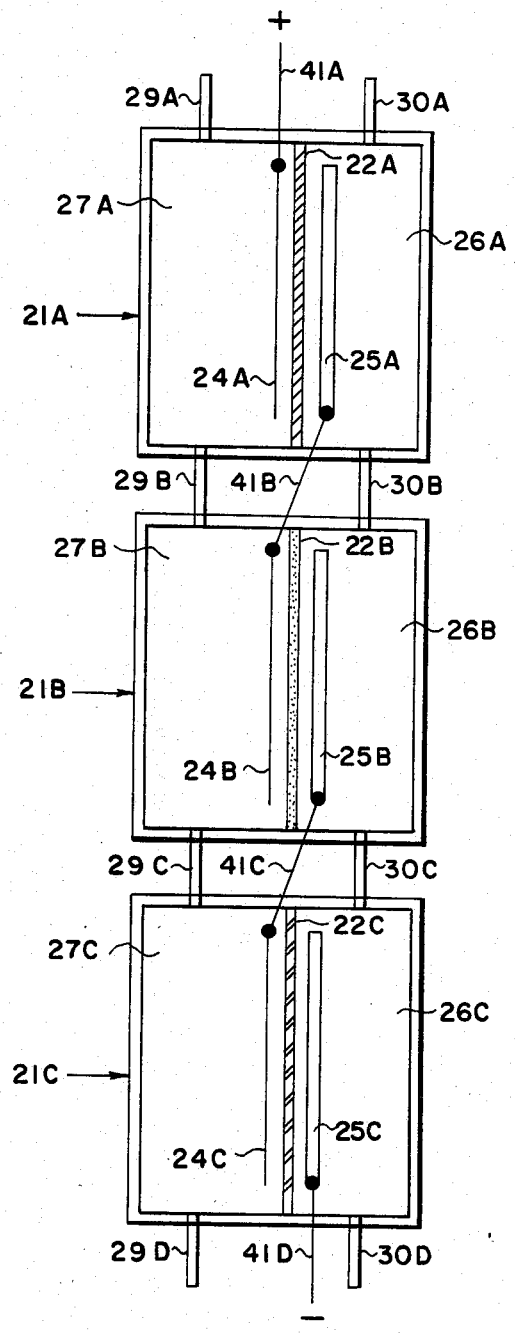
FIG. 2 is a plan view of a group of three cells illustrating a continuous embodiment of the process of the present invention.

FIG. 2 illustrates a preferred embodiment of the invention adaptable to the continuous production of potassium peroxydiphosphate. Cell 21A comprises anode compartment 27A containing anode 24A and cathode compartment 26A containing cathode 25A, said compartments separated by separating means 22A. Anode 24A is connected by electrical lead 41A to the positive connection of a source of direct currrent, not shown. Anolyte feed line 29A conducts an aqueous potassium phosphate anolyte from a source, not shown, into anolyte compartment 27A, and catholyte feed line 30A conducts an aqueous potassium hydroxide solution from a source, not shown, into catholyte compartment 26A. Concomitantly anolyte and catholyte are conducted from compartments 27A and 26A through feed lines 29B and 30B into the respective anolyte compartment 27B and catholyte compartment 26B of cell 21B.

Cells 21B and 21C are similar to cell 21A except for electrical lines 41B, 41C and 41D and separating means 22A, 22B and 22C each of which are discussed subsequently.

The cells 21A, 21B and 21C are arranged as a "cascade". That is, the elevation of each cell is lower than that of the preceding cell so that the anolyte and catholyte flow by gravity from the upper cell and cascade into the lower cell. The effluent anolyte from anode compartment 27C is a solution of potassium peroxydiphosphate suitable for use as such or for crystallizing the solid product. This solution is conducted from the cascade of cells through line 29D. Similarly spent catholyte is conducted by line 30D from cell 21C for reuse as catholyte or to make up anolyte.

Although the cells could be connected electrically in parallel, they are shown to be in series in FIG. 2. That is, the cathode 25A is connected by electrical lead 41B to anode 24B, and corresponding cathode 25B is connected to anode 24C by electrical line 41C and cathode 25C is connected to the negative connection of the said direct current source. In a commercial scale unit the number of cells would not be limited to three as in FIG. 2, but might range from 30 to 50 or more.

In FIG. 2 three types of separating means are shown for illustrating the invention although two separating means are generally sufficient. They are (1) a cation permeable membrane as separating means 22A, (2) an anion permeable membrane as separating means 22B and (3) a porous diaphragm permeable to both anions and cations as separating means 22C.

In operation an aqueous anolyte comprising potassium phosphate with a pH of 14 from a source, not shown, is introduced through line 29A into anolyte compartment 27A of cell 21A while an aqueous potassium hydroxide solution is introduced from a source, not shown, through line 30A into catholyte compartment 26A. Potassium peroxydiphosphate is produced at anode 24A at a current efficiency of 80% and the electrical current is conducted by the transfer of potassium ions through separating means 22A from anode compartment 27A into cathode compartment 26A. Hydrogen ions generated by reaction (2) neutralize hydroxyl ions in the anolyte. The effluent anolyte is conducted througuh line 29B into anode compartment 27B and comprises an aqueous solution of potassium phosphate and potassium peroxydiphosphate at a pH of 13. At anode 24B more potassium peroxydiphosphate is formed but at a current efficiency of 50%.

The electrical current is conducted by the transfer of sufficient hydroxyl ions from cathode compartment 26B through separating means 22B into anode compartment 27B and are not only sufficient to neutralize all of the hydrogen ions produced by reaction (2), but also to increase the pH of the anolyte effluent to 13.7. The anolyte effluent from anode compartment 27B is conducted by line 29C into anode compartment 27C. There, more potassium peroxydiphosphate is produced at anode 24C but at a reduced current efficiency of 20% because of the reduced phosphate ion concentration in the anolyte. Current is conducted through separating means 22C both by transfer of potassium ions from anode compartment 27C into cathode compartment 26C, and also by hydroxyl ions from cathode compartment 26C into anode compartment 27C. However, insufficient hydroxyl ions are transferred into the anolyte to neutralize all of the hydrogen ions formed by reaction (2) and the pH of the product potassium peroxydiphosphate solution effluent from anode compartment 27C falls to 13.2. The effluent anolyte is conducted by line 29D from the cells and may be used as such or crystallized.

For simplicity the cathode reaction is assumed to be the reduction of water to form hydrogen gas in each cell. The catholyte potassium hydroxide solution flows through the cells similarly to the anolyte from cathode compartments 26A, 26B and 26C through lines 30B, 30C and the potassium hydroxide catholyte effluent from line 30D is collected and may be recycled as catholyte or used to make up additional anolyte.

The best mode of practicing the present invention will be evident to one skilled in the art from the following examples. For uniformity, the examples are in trms of a cell consisting of a platinum anode immersed in an anolyte, a porous diaphragm, and a nickel cathode immersed in a potassium hydroxide catholyte. The cathode reaction is the reduction of water to form hydroxyl ions and hydrogen gas. The electrolytic cells were fabricated from methylmethacrylate resin with inside dimensions of 11.5 cm×10.2 cm×3.2 cm. A porous ceramic diaphragm separated one cell into anode and cathode compartments and an anion permeable membrane the other. The anodes were made of platinum ribbon strips with a total surface area of 52.5 $cm^2$. The cathode was nickel with an area of about 136 $cm^2$. Each cell was maintained at 30° C. by glass coating coils.

The anolyte contained 2.8 M/1 of $K_3PO_4$ and 0.7 M/1 of $K_2HPO$. About 0.38 M/1 of $KNO_3$ was added to the anolyte as the additive to improve current efficiency. About 394 g of anolyte was used in the electrolytic experiments. The catholyte contained 6.85 m/1 of KOH. About 358 g of this solution was used in the experiments.

In run 1, the anolyte and catholyte were charged to the cell with a porous ceramic diaphragm. Electrolysis was carried out at an anode current density of 0.15 A/$cm^2$ at 30° C. for 6 hours. The cell voltage was 4.9–5.5 volts. The anolyte pH was measured periodically. At the end of the run, peroxydiphosphate concentration in the anolyte was determined and the current efficiency was calculated.

In run 2, the cell with an anionic-selective membrane was used. Electrolysis was carried out for 5 hours. Other operational conditions were substantially the same as those in run 1.

Run 3 is the inventive example in which both cells were used. The experiment was carried out in 4 steps to simulate the operation of a 4 cell cascade. The operating conditions for each step were substantially the same as those for run 1. In step 1, freshly prepared anolyte and catholyte were charged to the cell with a porous ceramic diaphragm and electrolysis was carried out for 90 minutes. In step 2, the anolyte and catholyte from step 1 were transferred to the cell with an anionic membrane and electrolysis was carried out for 60 minutes. Steps 3 and 4 were the repeats of steps 1 and 2 except the anolyte and catholyte used were from the previous step.

Results from runs 1 to 3 are tabulated in Table I.

Results from run 1 show that the pH of the anolyte decreased progressively during electrolysis when a porous ceramic diaphragm was used as the cell separator. Results from run 2 show that the pH of the anolyte increased during electrolysis when an anionic membrane was used. Results from run 3 show that the pH of the anolyte oscillated as the anolyte flowed through a string or cascade of cells with porous ceramic diaphragms and anionic membranes.

It can be seen with only four cells, each containing a single anode, a single cathode and a single separating means, it is possible to maintain the pH within 1 unit during electrolysis. The pH range can be maintained even within a narrower pH range by increasing the number of cells within the cascade and decreasing the residence time of the anolyte in a cell.

TABLE I

CHANGES OF ANOLYTE pH DURING ELECTROLYSIS

| Run 1 Porous Ceramic | | Run 2 Anionic Membrane | | Run 3 Porous Ceramic/ Anionic Membrane* | |
|---|---|---|---|---|---|
| Time, min. | pH | Time, min. | pH | Time, min. | pH |
| 0 | 13.03 | 0 | 13.03 | 0 | 13.17 |
| 90 | 12.86 | 60 | 13.74 | 90 | 12.95 |
| 180 | 12.67 | 120 | 14.70 | 150 | 13.48 |
| 270 | 12.47 | 180 | 14.91 | 240 | 13.06 |
| 360 | 12.19 | 240 | 15.02 | 300 | 13.93 |

TABLE I-continued

CHANGES OF ANOLYTE pH DURING ELECTROLYSIS

| Run 1 Porous Ceramic | | Run 2 Anionic Membrane | | Run 3 Porous Ceramic/ Anionic Membrane* | |
|---|---|---|---|---|---|
| Time, min. | pH | Time, min. | pH | Time, min. | pH |
| Av. Current Efficiency = 23.0% | | 22.5% | | | 27.9% |

*Ceramic diaphragm used during 0-90 min. and 150-240 min., anionic membrane used during 90-150 min. and 240-300 min.

What is claimed is:

1. In the process for producing potassium peroxydiphosphate in an aqueous, alkaline potassium phosphate anolyte in an anode compartment containing a noble metal anode, said anolyte being separated from an aqueous catholyte in an adjacent cathode compartment by separating means preventing a substantial flow of aqueous anolyte and catholyte between the adjacent anode and cathode compartments, and applying sufficient electric potential between the anode and a cathode in the cathode compartment (a) to oxidize phosphate anions at the anode to form peroxyphosphate anions, (b) to transfer cations from an anode compartment into an adjacent cathode compartment, and (c) to transfer hydroxyl anions from a cathode compartment into an adjacent anode compartment, the improvement comprising employing (i) a first separating means permeable to either an anion or a cation but substantially excluding the other ion, and (ii) a second separating means permeable to the ion excluded by the first separating means, said first and second separating means each having one surface contacting anolyte and another surface contacting catholyte, said first and second separating means transferring anions and cations in sufficient quantity to maintain the anolyte within a range of 1 pH unit.

2. The process of claim 1 wherein the anolyte feed is about 3 to 4 molar in phosphate ions and the anolyte is maintained between about pH 13 and pH 14.

3. The process of claim 1 wherein the anolyte feed is about 1.5 to 2.5 molar in phosphate ions and the anolyte is maintained between pH 12 and pH 13.

4. The process of claim 1 wherein the first separating means is an anion permeable membrane and the second separating means is a porous diaphragm permeable to both anions and cations.

5. The process of claim 1 wherein the first separating means is a cation permeable membrane and the second separating means is a porous diaphragm permeable to both anions and cations.

6. The process of claim 1 wherein the first separating means is an anion permeable membrane and the second separating means is a cation permeable membrane.

7. A process for producing potassium peroxydiphosphate in an anolyte comprising an aqueous, alkaline potassium phosphate solution, said process comprising: (1) introducing said anolyte into an anode compartment of an electrolytic cell consisting of (a) an anode compartment containing a noble metal anode, and (b) at least one cathode compartment containing (i) a cathode, and (ii) an aqueous catholyte solution comprising an alkali metal hydroxide, (c) said anode and cathode compartments being separated by (i) a first separating means preventing a substantial flow of aqueous solution between adjacent anode and cathode compartments but permeable to either an anion or a cation but substantially excluding the other ion, and (ii) a second separating means preventing a substantial flow of aqueous solution between adjacent anode and cathode compartments and permeable to the ion excluded by the first separating means, said first and second separating means each having one surface contacting anolyte and another surface contacting catholyte and (2) applying sufficient electric potential between the anodes and cathodes (a) to oxidize phosphate anions at the anodes to form peroxyphosphate anions, (b) to transfer cations from an anode compartment into an adjacent cathode compartment, and (c) to transfer hydroxyl anions from a cathode compartment into an adjacent anode compartment in sufficient quantity to maintain the anolyte within a range of 1 pH unit.

8. The process of claim 7 wherein the anolyte feed is about 3 to 4 molar in phosphate ions and the anolyte is maintained between about pH 13 and pH 14.

9. The process of claim 7 wherein the anolyte feed is about 1.5 to 2.5 molar in phosphate ions and the anolyte is maintained between pH 12 and pH 13.

10. The process of claim 7 wherein the first separating means is an anion permeable membrane and the second separating means is a porous diaphragm permeable to both anions and cations.

11. The process of claim 7 wherein the first separating means is a cation permeable membrane and the second separating means is a porous diaphragm permeable to both anions and cations.

12. The process of claim 7 wherein the first separating means is an anion permeable membrane and the second separating means is a cation permeable membrane.

13. A process for producing potassium peroxydiphosphate in an anolyte comprising an aqueous, alkali potassium phosphate solution, said process comprising: (1) introducing said anolyte into an anode compartment of a plurality of electrolytic cells in cascade, said plurality of electrolytic cells each consisting of (a) an anode compartment containing a noble metal anode, and (b) at least one cathode compartment containing (i) a cathode, and (ii) an aqueous catholyte solution comprising an alkali metal hydroxide, (c) said anode and cathode compartments being separated by (i) a first separating means preventing a substantial flow of aqueous solution between adjacent anode and cathode compartments but permeable to either an anion or a cation but substantially excluding the other ion, and (ii) a second separating means preventing a substantial flow of aqueous solution between adjacent anode and cathode compartments and permeable to the ion excluded by the first separating means, said first and second separating meahs each having one surface contacting anolyte and another surface contacting catholyte and (2) applying sufficient electric potential between the anodes and cathodes (a) to oxidize phosphate anions at the anodes to form peroxyphosphate anions, (b) to transfer cations from an anode compartment into an adjacent cathode compartment, and (c) to transfer hydroxyl anions from a cathode compartment into an adjacent anode compartment in sufficient quantity to maintain the anolyte within a range of 1 pH unit throughout the plurality of cells.

14. The process of claim 13 wherein the anolyte feed is about 3 to 4 molar in phosphate ions and the anolyte is maintained between about pH 13 and pH 14.

15. The process of claim 13 wherein the anolyte feed is about 1.5 to 2.5 molar in phosphate ions and the anolyte is maintained between pH 12 and pH 13.

16. The process of claim 13 wherein the first separating means is an anion permeable membrane and the second separating means is a porous diaphragm permeable to both anions and cations.

17. The process of claim 13 wherein the first separating means is a cation permeable membrane and the second separating means is a porous diaphragm permeable to both anions and cations.

18. The process of claim 13 wherein the first separating means is an anion permeable membrane and the second separating means is a cation permeable membrane.

19. The process of claim 13 wherein at least one anode and cathode compartment are separated by a third separating means and the first separating means is an anion permeable membrane, the second separating means is a cation permeable membrane and the third separating means is a diaphragm permeable to both anions and cations.

* * * * *